US008328533B2

(12) United States Patent
Yu et al.

(10) Patent No.: US 8,328,533 B2
(45) Date of Patent: Dec. 11, 2012

(54) HEAT DISSIPATION FAN

(75) Inventors: Fang-Xiang Yu, Shenzhen (CN); Jer-Haur Kuo, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 788 days.

(21) Appl. No.: 12/488,524

(22) Filed: Jun. 20, 2009

(65) Prior Publication Data

US 2010/0232931 A1 Sep. 16, 2010

(30) Foreign Application Priority Data

Mar. 13, 2009 (CN) ..... 2009 1 0300841

(51) Int. Cl.
*F04B 39/06* (2006.01)
*H02K 7/00* (2006.01)
*F01D 25/08* (2006.01)

(52) U.S. Cl. ..... 417/353; 417/366; 417/423.8; 310/67 R; 415/229

(58) Field of Classification Search ..... 417/353, 417/423.8, 423.12, 366; 310/67 R, 68 B, 310/68 R; 415/229; 416/174
See application file for complete search history.

(56) References Cited

U.S. PATENT DOCUMENTS

| | | | | |
|---|---|---|---|---|
| 4,686,400 | A * | 8/1987 | Fujisaki et al. | 310/67 R |
| 6,491,502 | B2 * | 12/2002 | Hunt | 417/360 |
| 7,300,262 | B2 * | 11/2007 | Ku et al. | 417/366 |
| 7,628,582 | B2 * | 12/2009 | Kanai et al. | 415/206 |
| 2003/0124001 | A1 * | 7/2003 | Chen | 417/356 |

* cited by examiner

*Primary Examiner* — Charles Freay
(74) *Attorney, Agent, or Firm* — Altis Law Group, Inc.

(57) ABSTRACT

A heat dissipation fan includes a base with a plurality of holes defined therein, a stator mounted on the base and being placed around the holes of the base, and an impeller rotatably attached to the base. The impeller includes a hub and a plurality of blades, the hub includes a top wall with a plurality of holes defined therein and an annular wall depending from the top wall. The blades are arranged around the annular wall of the hub. An axial air passage is defined in the stator. The holes of the base communicate with the holes of the top wall via the air passage.

10 Claims, 7 Drawing Sheets

HEAT DISSIPATION FAN

BACKGROUND

1. Technical Field

The disclosure generally relates to heat dissipation fans, and particularly to a heat dissipation fan having an improved heat dissipation efficiency.

2. Description of Related Art

It is well known that if heat generated by electronic components such as integrated circuit chips during operation is not efficiently removed, these electronic components may suffer damage. Thus, heat dissipation apparatuses are often used to cool the electronic components.

A typical heat dissipation apparatus includes a heat sink and a fan mounted on the heat sink. The fan includes a base having a bearing tube extending upwardly therefrom, a stator mounted around the bearing tube, and an impeller rotatably attached to the bearing tube. The impeller includes a hub and a plurality of blades arranged around the hub.

During operation, heat generated by the electronic component is transferred to the heat sink, the blades of the fan drive air surrounding the hub to generate a forced airflow to cool the heat sink. Since no air pass through the hub, a portion of the heat sink under the hub can not be cooled. Thus, a non-cooled area of the heat sink is formed near the hub, which results in a low heat dissipation efficiency of the fan.

For the foregoing reasons, a heat dissipation fan which can overcome the above described limitations is desired.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
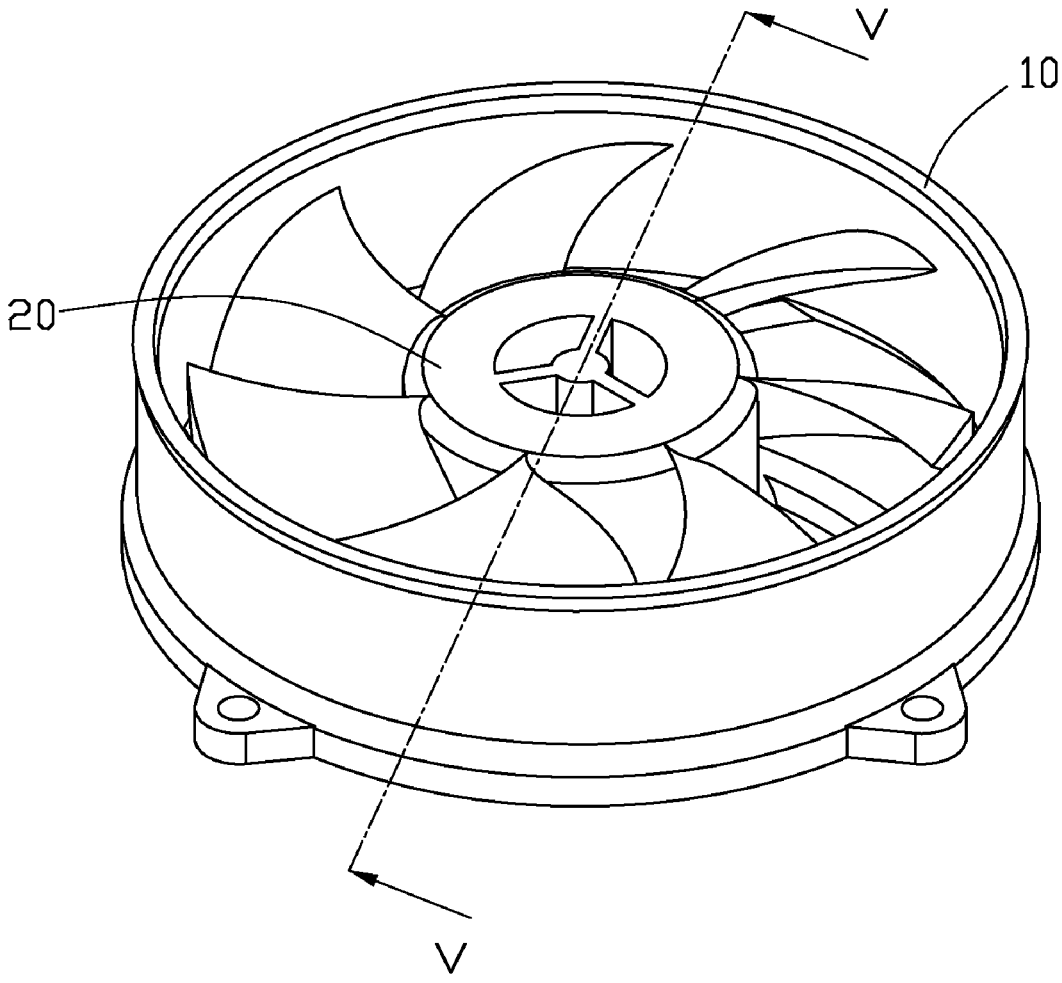
FIG. 1 is an assembled view of a heat dissipation fan according to an exemplary embodiment of the present disclosure.
Figure 2:
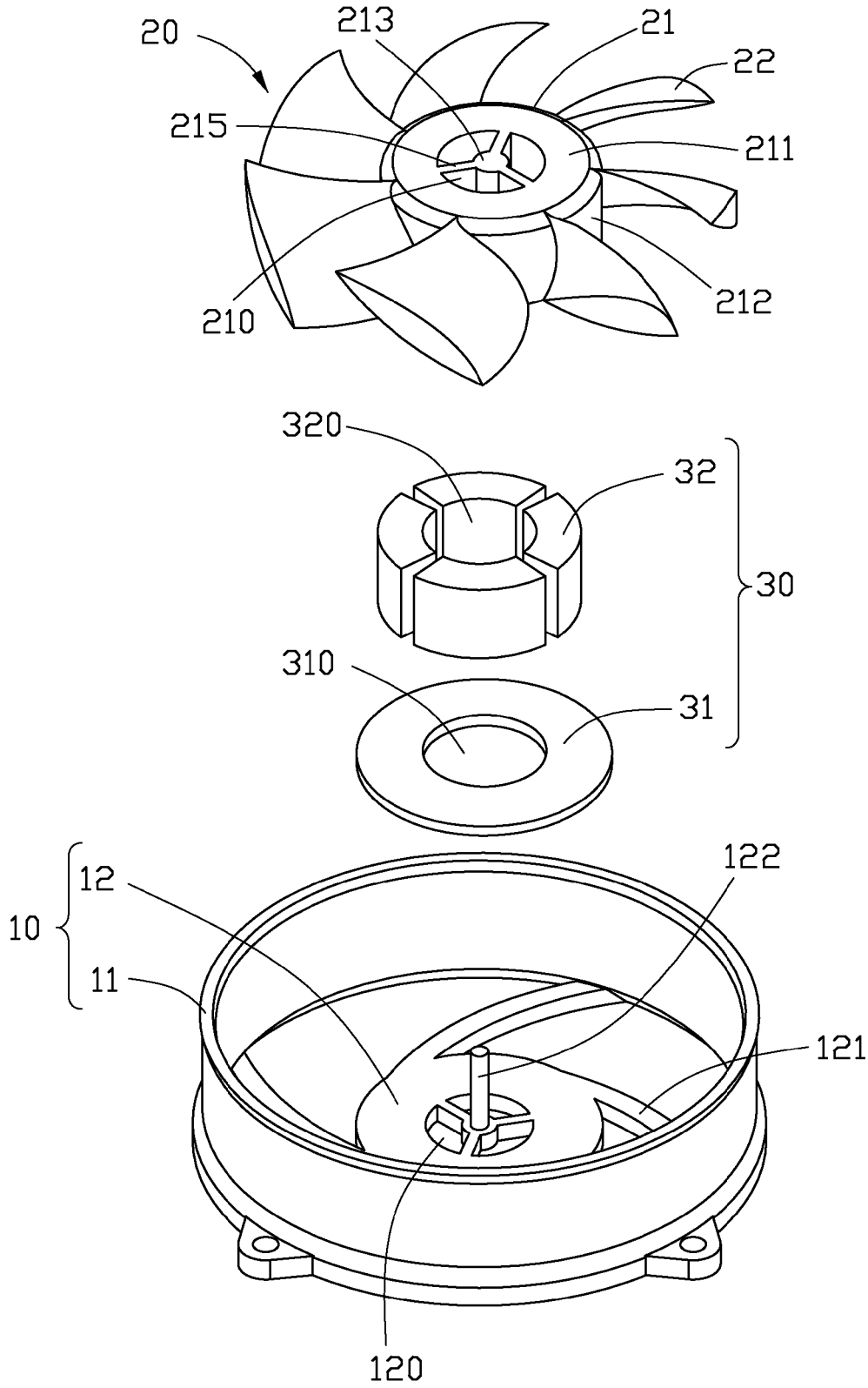
FIG. 2 is an exploded view of the heat dissipation fan of FIG. 1.

Referring to FIGS. 1 and 2, a heat dissipation fan according to an exemplary embodiment of the present disclosure is shown. The heat dissipation fan includes a fan housing 10, a stator 30 received in the fan housing 10, and an impeller 20 rotatably received in the fan housing 10.

The fan housing 10 includes an annular-shaped frame 11 and a base 12 positioned in a central portion of the frame 11.

The base 12 is substantially disk-shaped. Three ribs 121 extend outwardly from an outer periphery of the base 12 along a tangential direction of the base 12, respectively. The ribs 121 are evenly distributed along a circumference of the base 12, and connect the base 12 to an inner surface of the frame 11. A shaft 122 extends perpendicularly and upwardly from a central portion of the base 12. Three through holes 120 are defined in a middle portion of the base 12. The through holes 120 enable an airflow exchanging between two sides of the base 12. Each of the through holes 120 is sector-shaped. The through holes 120 are evenly arranged around the shaft 122, and spaced from each other. Outer sides of the three through holes 120 cooperatively define an imaginary circle, which is concentric with the base 12.

Figure 3:
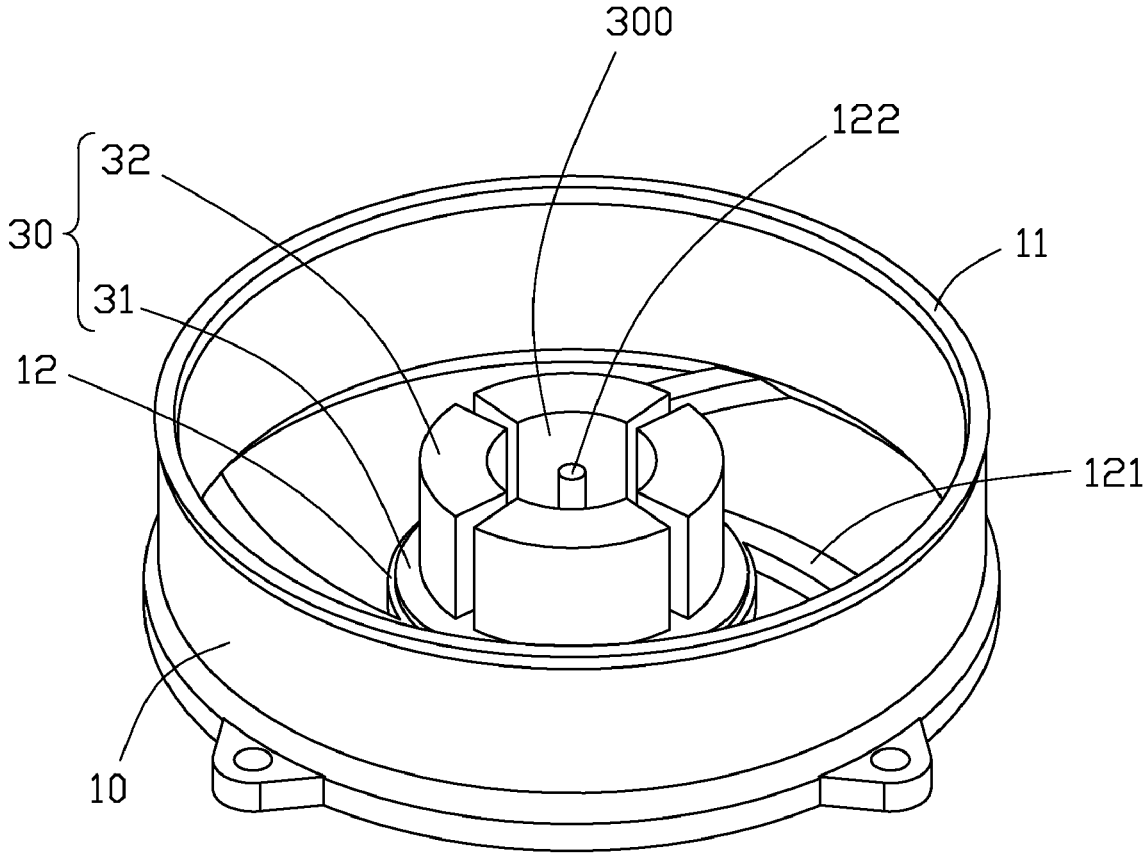
FIG. 3 is an isometric view showing a fan housing of the heat dissipation fan of FIG. 1, wherein a stator is assembled in the fan housing.

The stator 30 includes a printed circuit board 31 and a stator core 32 mounted on the printed circuit board 31. The printed circuit board 31 is disk-shaped and has an aperture 310 defined in a middle portion thereof. A diameter of the aperture 310 is substantially the same as that of the imaginary circle defined by the through holes 120 of the base 12. The stator core 32 is cylindrical-shaped, and defines an air passage 320 along an axial direction thereof. The stator 30 is mounted on the base 12 around the through holes 120 of the base 12, and the through holes 120 of the base 12 communicate with the aperture 310 and the air passage 320. The shaft 122 of the base 12 is received in the air passage 320 of the stator 30 (referring to FIG. 3). The air passage 320 of the stator 30 has a central axis collinear with the shaft 122.

Figure 4:
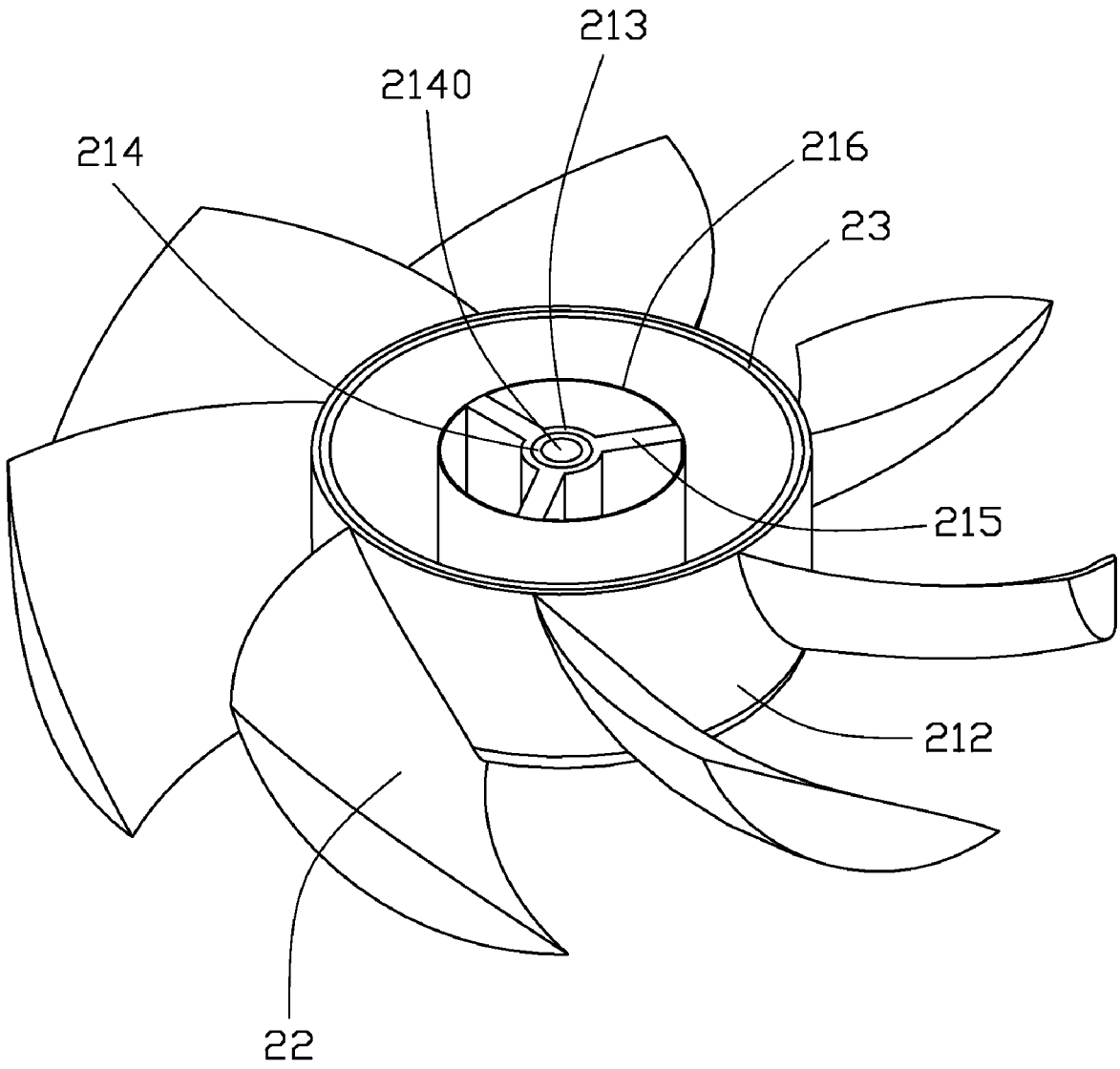
FIG. 4 is an isometric view showing an impeller of the heat dissipation fan of FIG. 1, viewed from a bottom aspect thereof.

Referring to FIGS. 2 and 4, the impeller 20 includes a hub 21 and a plurality of blades 22 arranged around and connecting with the hub 21. The hub 21 includes a circular top wall 211, an annular wall 212 depending from a circumference of the top wall 211, and a bearing tube 213 extending perpendicularly and downwardly from a central portion of the top wall 211. The bearing tube 213 is tubular-shaped with a bearing 214 mounted therein via interference fit. The bearing 214 defines a bearing hole 2140 for accommodating the shaft 122 of the base 12 therein. The blades 22 are arranged on an outer surface of the annular wall 212. A magnet ring 23 is mounted on an inner surface of the annular wall 212. The top wall 211 faces downwardly to the base 12. Three ventilating holes 210 are defined in a middle portion of the top wall 211 corresponding to the through holes 120 of the base 12. Each of the ventilating holes 210 has a shape, i.e., sector-shaped, similar to that of the corresponding through hole 120 of the base 12. The ventilating holes 210 are evenly arranged around the bearing tube 213, and spaced from each other.

A ventilating tube 216 surrounding the bearing tube 213 extends downwardly and perpendicularly from the top wall 211 around the ventilating holes 210. The ventilating tube 216 is substantially tubular and coaxial to the bearing tube 213. An outer diameter of the ventilating tube 216 is a little smaller than that of the air passage 320 of the stator 30. An outer surface of the ventilating tube 216 is spaced from the stator 30. There holding pates 215 are formed between the bearing tube 213 and the ventilating tube 216. The three holding plates 215 are evenly arranged around the bearing tube 213. Each of the holding plates 215 extends perpendicularly and downwardly from a portion of the top wall 211 between every two adjacent ventilating holes 210 and connects between the ventilating tube 216 and the bearing tube 213. A space between the bearing tube 213 and the ventilating tube 216 is divided by the holding plates 215 into three equal parts. The ventilating tube 216 and the holding plates 215 realize a more firm connection between the bearing tube 213 and the top wall 211.

Figure 5:
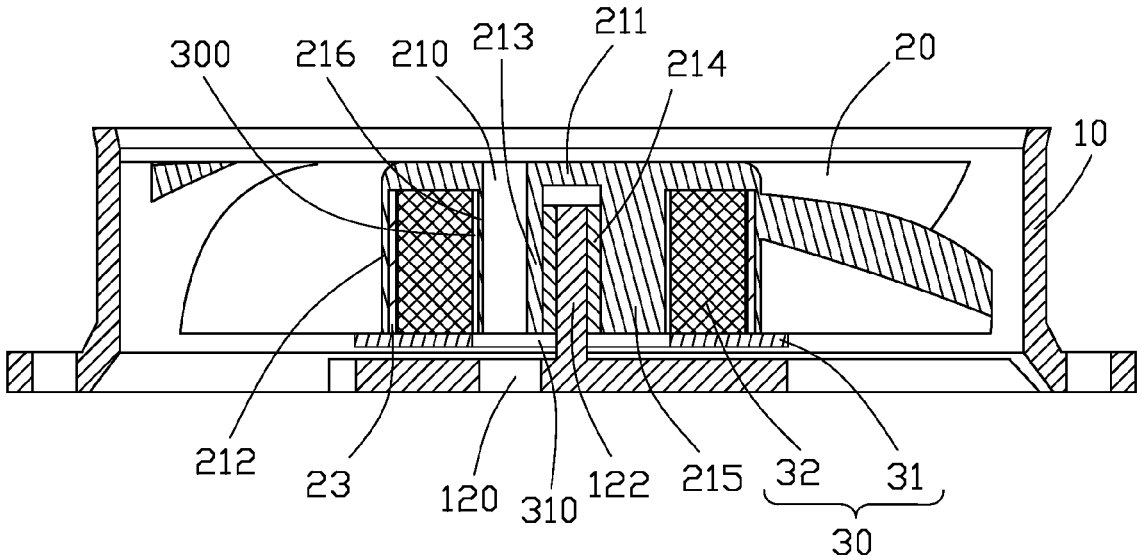
FIG. 5 is a cross sectional view of the heat dissipation fan of FIG. 1, taken along line V-V thereof.

Referring to FIG. 5, in assembly of the of the heat dissipation fan, the impeller 20 is received in the fan housing 10 with the ventilating tube 216 extending into the air passage 320 of the stator 30 and being spaced from the stator 30. The shaft 122 of the base 12 is fittingly received in the bearing 214. The magnet ring 23 of the impeller 20 surrounds the stator 30. The through holes 120 of the base 12 face upwardly toward the ventilating holes 210 of the impeller 20.

During operation, the impeller 20 rotates due to the interaction of the alternating magnetic field established by the stator core 32 of the stator 30 and the magnet ring 23 of the impeller 20. The rotary blades 22 generate a forced airflow around a circumference of the hub 21. An air pressure difference between the top and bottom sides of the heat dissipation fan is established due to the forced airflow generated by the blades 22. For the air pressure difference, the air at two sides of the heat dissipation fan flows continually through the ventilating holes 210, the ventilating tube 216 and the through holes 120. Thus, the airflow can reach an area under the hub 21 of the heat dissipation fan. When the heat dissipation fan is mounted on a heat sink, a portion of the heat sink under the hub 21 of the heat dissipation fan can be well cooled by the airflow flowing through the hub 21. Thus, the non-cooled area of the heat sink is reduced, which enhances the heat dissipation efficiency of the heat dissipation fan.

In addition, during operation, the stator 30 is electrified to maintain a rotation of the impeller 20. The stator 30 generates heat continuously due to the eddy current thereof. Since the bearing tube 213 is spaced from the stator 30 by the air passage 320, the heat generated by the stator core 32 can not be transferred to the bearing tube 213. At the same time, heat generated by the bearing 214 due to the friction between the bearing 214 and the shaft 122 can be taken away timely by the airflow passing through the air passage 320. Thus, the bearing tube 213 and the bearing 214 therein keeps a low temperature, which decelerates the evaporation of the lubricant in the bearing tube 213 and enables the heat dissipation fan to have an extended life.

Figure 6:
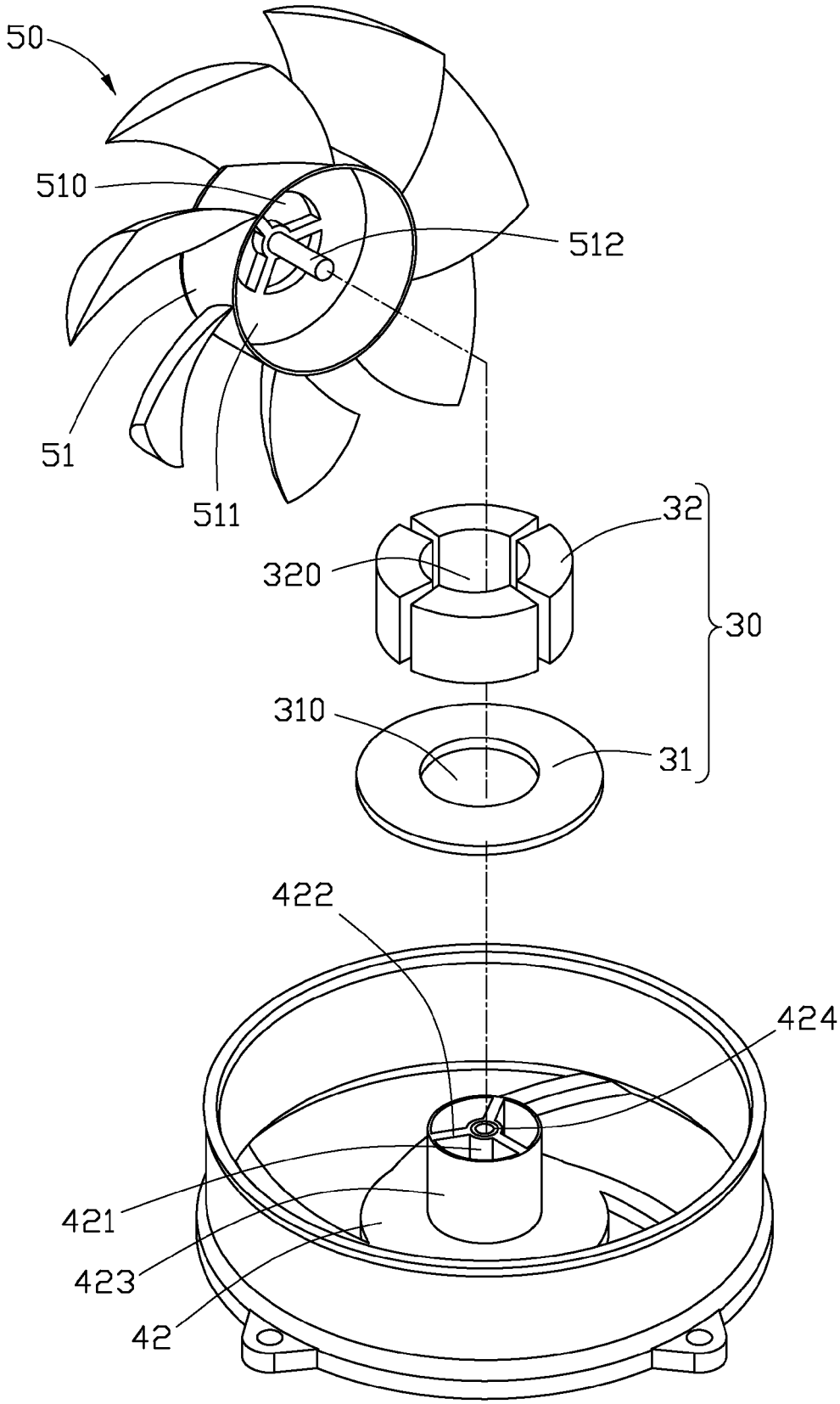
FIG. 6 is an exploded view of a heat dissipation fan according to an alternative embodiment of the present disclosure.
Figure 7:
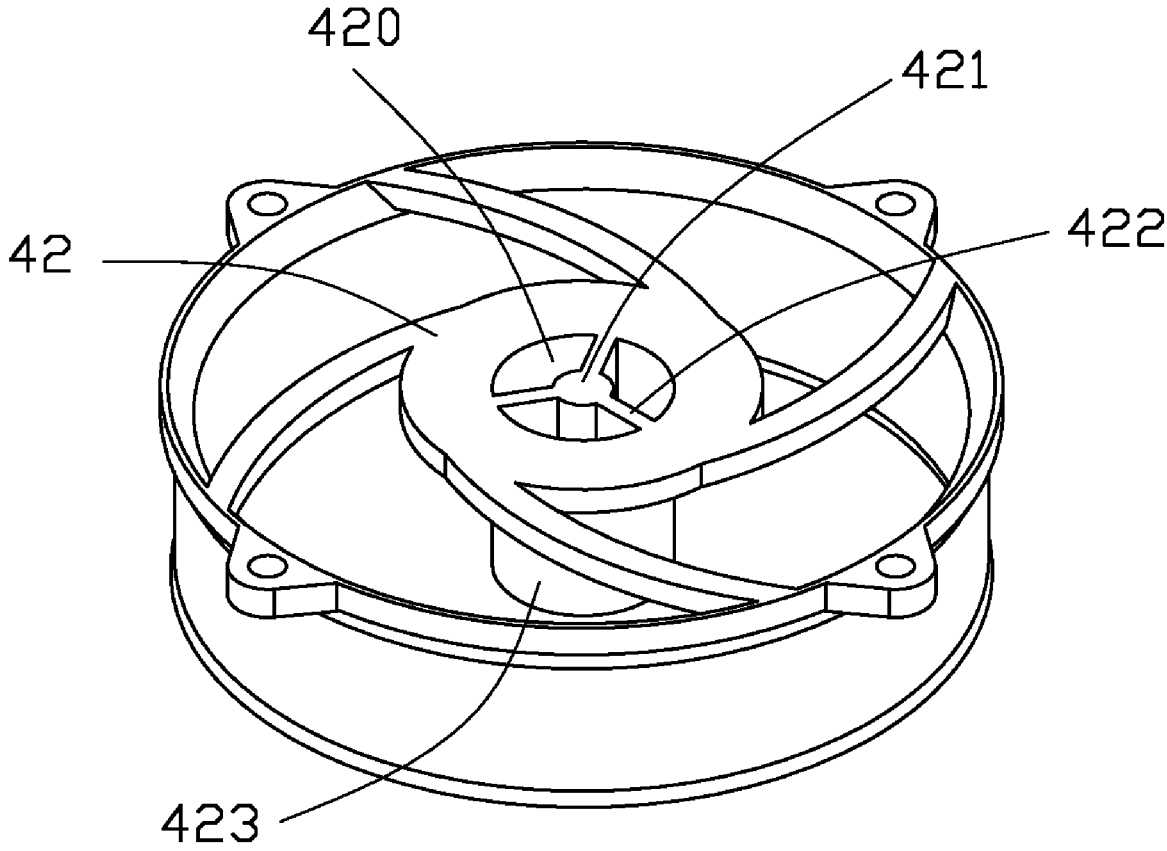
FIG. 7 is an isometric view showing a fan housing of the heat dissipation fan of FIG. 6, viewed from a bottom aspect thereof.

FIGS. 6 and 7 show a heat dissipation fan according to an alternative embodiment of the disclosure, differing from the previous embodiment in that the top wall 511 of the impeller 50 has a shaft 512 extending downwardly from a central portion thereof. Three ventilating holes 510 are defined in the top wall 511 and evenly arranged around the shaft 512. A bearing tube 421 and a ventilating tube 423 extend perpendicularly from the base 42 towards the top wall 511 of the hub 51. A bearing 424 is received in the bearing tube 421 for supporting rotation of the shaft 512 of the impeller 50 therein. Three through holes 420 (FIG. 6) are defined in the base 42 and evenly arranged around the bearing tube 421. A holding pate 422 is formed between every two adjacent through holes 420, and connects the ventilating tube 423 with the bearing tube 421. The holding plates 422 divide the space between the ventilating tube 423 and the bearing tube 421 into three equal portions The stator 30 is mounted around the ventilating tube 423, and the impeller 50 is rotatably attached on the base 42 with the shaft 512 extending into the bearing 424. The air passage 320 communicates the top side of the heat dissipation fan through the ventilating holes 510 of the hub 51. When the impeller 50 rotates, a portion of an airflow generated by the rotated impeller 50 flows from the ventilating holes 510 into the air passage 320, and another portion of the airflow flows from the ventilating holes 510 via ventilating tube 423 downwardly into the through holes 420.

It is understood that the invention may be embodied in other forms without departing from the spirit thereof. Thus, the present examples and embodiments are to be considered in all respects as illustrative and not restrictive, and the invention is not to be limited to the details given above.

What is claimed is:

1. A heat dissipation fan comprising:

a base;

a stator mounted on the base; and an impeller rotatably attached to the base, the impeller comprising a hub and a plurality of blades, the hub comprising a top wall and an annular wall depending from the top wall, the top wall facing downwardly toward the base, the annular wall surrounding the stator, the blades being arranged around the annular wall, a shaft extending perpendicularly from one of the base and the top wall, a bearing tube extending perpendicularly from the other one of the base and the top wall, the shaft being rotatably received in the bearing tube;

wherein the stator defining an air passage therein along an axial direction of the impeller, each of the top wall and the base defining a plurality of holes, the holes of the top wall communicating with the holes of the base via the air passage, the bearing tube extending into the air passage and being spaced from the stator;

wherein the air passage communicates with the holes of the top wall and the base, the shaft extends upwardly from a central portion of the base, the holes of the base are evenly arranged around the shaft, the bearing tube extends from a central portion of the top wall, the holes of the top wall are evenly arranged around the bearing tube; and wherein a holding plate is formed between every two adjacent holes of the top wall, each of the holding plates extending perpendicularly from the top wall towards a bottom of the hub and connecting with an outer surface of the bearing tube, each of the holding plates being spaced from the stator.

2. The heat dissipation fan of claim 1, wherein a ventilating tube extends from a portion around the holes of the top wall of the hub, the bearing tube being surrounded by the ventilating tube, the holes of the top wall being located between the ventilating tube and the bearing tube, each of the holding plates connects between the ventilating tube and the bearing tube, the ventilating tube extending into the air passage of the stator, an outer surface of the ventilating tube is spaced from the stator.

3. The heat dissipation fan of claim 1, wherein the shaft extends downwardly from a center portion of the top wall of the hub, the holes of the top wall are arranged around the shaft, the bearing tube extends upwardly from a central portion of the base, the holes of the base are evenly arranged around the bearing tube.

4. The heat dissipation fan of claim 3, wherein a holding plate is formed between every two adjacent holes of the base, each of the holding plates extending perpendicularly from the base towards the top wall and connects with an outer surface of the bearing tube, each of the holding plates being spaced from the stator.

5. The heat dissipation fan of claim 4, wherein a ventilating tube extends from a portion around the holes of the base, the bearing tube is surrounded by the ventilating tube, the holes of the base are located between the ventilating tube and the bearing tube, each of the holding plates connects between the ventilating tube and the bearing tube.

6. The heat dissipation fan of claim 5, wherein the stator is mounted around the ventilating tube.

7. A heat dissipation fan comprising:

a base:

a stator mounted on the base; and an impeller rotatably attached to the base, the impeller comprising a hub and a plurality of blades, the hub comprising a top wall and an annular wall depending from the top wall, the top wall facing downwardly toward the base, the annular gall surrounding the stator, the blades being arranged around the annular wall, a shaft extending perpendicularly from one of the base and the top wall, a bearing tube extending perpendicularly from the other one of the base and the top wall, the shaft being rotatably received in the bearing tube;

wherein the stator defining an air passage therein along an axial direction of the impeller, each of the top wall and the base defining a plurality of holes, the holes of the top wall communicating with the holes of the base via the air passage, the bearing tube extending into the air passage and being spaced from the stator;

wherein the passage communicates with the holes of the top wall, the shaft extends downwardly from a center portion of the top wall of the hub, the holes of the top wall are arranged around the shaft, the bearing tube extends upwardly from a central portion of the base, the holes of the base are evenly arranged around the bearing tube; and wherein a holding plate is formed between every two adjacent holes of the base, each of the holding plates extending perpendicularly from the base towards the top wall and connects with an outer surface of the bearing tube, each of the holding plates being spaced from the stator.

8. The heat dissipation fan of claim 7, wherein a ventilating tube extends from a portion around the holes of the base, the bearing tube is surrounded by the ventilating tube, the holes of the base are located between the ventilating tube and the bearing tube, each of the holding plates connects between the ventilating tube and the bearing tube.

9. The heat dissipation fan of claim 8, wherein the stator is mounted around the ventilating tube.

10. The heat dissipation fan of claim 7, wherein a ventilating tube extends from a portion around the holes of the top wall of the hub, the bearing tube being surrounded by the ventilating tube, the holes of the top wall being located between the ventilating tube and the bearing tube, each of the holding plates connects between the ventilating tube and the bearing tube, the ventilating tube extending into the air passage of the stator, an outer surface of the ventilating tube is spaced from the stator.

* * * * *